US007473403B2

(12) United States Patent
Jobson et al.

(10) Patent No.: US 7,473,403 B2
(45) **Date of Patent: *Jan. 6, 2009**

(54) DEVICE FOR TREATMENT OF A GAS FLOW

(75) Inventors: Edward Jobson, Romelanda (SE); Anna Holmgren Hägg, Torslanda (SE)

(73) Assignees: Volvo Technology Corporation, Gothenburg (SE); Ford Global Technologies, Inc., Dearborn, MI (US)

( * ) Notice: Subject to any disclaimer, the term of this patent is extended or adjusted under 35 U.S.C. 154(b) by 675 days.

This patent is subject to a terminal disclaimer.

(21) Appl. No.: 10/710,968

(22) Filed: Aug. 15, 2004

(65) Prior Publication Data

US 2005/0079110 A1 Apr. 14, 2005

Related U.S. Application Data

(63) Continuation of application No. PCT/SE03/00222, filed on Feb. 11, 2003.

(30) Foreign Application Priority Data

Feb. 15, 2002 (SE) ..... 0200452

(51) Int. Cl.
*F01N 3/10* (2006.01)

(52) U.S. Cl. ..... 422/173; 422/176

(58) Field of Classification Search ..... 422/173, 422/174, 176, 177, 179, 180
See application file for complete search history.

(56) References Cited

U.S. PATENT DOCUMENTS

| | | | | |
|---|---|---|---|---|
| 3,885,977 | A | 5/1975 | Lachman et al. | 501/119 |
| 4,385,032 | A * | 5/1983 | Fratzer et al. | 422/176 |
| 5,660,800 | A | 8/1997 | Mieville et al. | 422/173 |
| 6,190,624 | B1 | 2/2001 | Romatier | 422/200 |

FOREIGN PATENT DOCUMENTS

| | | | |
|---|---|---|---|
| EP | 1016777 | A2 | 7/2000 |
| WO | WO 9214912 | A1 | 9/1992 |
| WO | WO 9411623 | A2 | 5/1994 |
| WO | WO 9518292 | A1 | 7/1995 |
| WO | WO 9621093 | A1 | 7/1996 |
| WO | WO 0229218 | A1 * | 4/2002 |

* cited by examiner

*Primary Examiner*—Tom Duong
(74) *Attorney, Agent, or Firm*—Novak Druce + Quigg, LLP

(57) ABSTRACT

Device for treatment of a gas flow including at least one body (3), at least one first opening (4, 4') for entrance of an incoming gas flow to the body (3) and at least one second opening (5, 5') for the exit of an outgoing gas flow from the body (3). The body (3) is provided with a plurality of gas flow passages (11*a*, 11*b*) arranged to permit heat exchange between the gas flows in adjacent passages. The device has at least one distribution section (26, 26') in communication with the first opening (4, 4') and with the gas flow passages (11*a*, 11*b*) to distribute the incoming gas flow to the gas flow passages (11*a*, 11*b*), and at least one gas flow passage section (27, 27') including the gas flow passages (11*a*, 11*b*), which passage section (27, 27') primarily is adapted to permit heat exchange and to cause a conversion in the composition of the gas.

24 Claims, 8 Drawing Sheets

B-B

A-A

D-D

C-C

B-B

A-A

DEVICE FOR TREATMENT OF A GAS FLOW

CROSS-REFERENCE TO RELATED APPLICATIONS

The present application is a continuation patent application of International Application No. PCT/SE03/00222 filed 11 Feb. 2003 which was published in English pursuant to Article 21(2) of the Patent-Cooperation Treaty, and which claims priority to Swedish Application No. 0200452-1 filed 15 Feb. 20025. Said applications are expressly incorporated herein by reference in their entireties.

TECHNICAL FIELD

The invention generally relates to a device for the treatment of a gas flow. In particular, the invention relates to a device for catalytic purification of exhaust gases emanating from internal combustion engines.

BACKGROUND ART

Exhaust gases emanating from such devices as internal combustion engines and industrial processes generally contain potentially hazardous compounds such as hydrocarbons (HC), carbon monoxide (CO), oxides of nitrogen (NOX) and particulates. Such compounds need to be converted to harmless, or at least less hazardous, compounds in order to reduce the amount of hazardous compounds released to the environment. Commonly the exhaust gases undergo some form of catalytic treatment and/or filtering process.

In most conversion-type treatments of interest in the present context, temperature is an important aspect.

Many important conversion reactions require a rather high temperature. The use of catalysts, for example metals or metal oxides from the platinum group, makes it possible to convert the hazardous compounds with a satisfactory reaction rate at a much lower temperature than if such catalysts were not used. However, a high reaction rate can only be achieved if the temperature is sufficient; that is, above the so called light-off temperature at which the catalyzed reaction rate becomes significant. The light-off temperature is usually in the range 200-400° C. If the light-off temperature has not yet been reached, or if the temperature falls below light-off so that conversion stops, almost no hazardous compounds will be converted. These are well-known problems associated with such things as the cold starting of an internal combustion engine (with a similarly cold catalyzer) and with "cold" exhaust gases, such as those emanating from a diesel engine.

The temperature is further important in regeneration of purification devices, for instance, the removal of trapped particles by combustion or the removal of impurities such as sulphur oxides (SOx) from a catalytic device. Such processes can be cyclic and involve a temperature increase to around 600° C. for a certain time period. As the purification devices normally degrade if they are exposed to overly high temperatures, there is an upper temperature limit that should not be exceeded. Thus, it is not only the temperature that is an important feature, but also the control of the temperature during both conversion (to achieve a good conversion) and during regeneration (to achieve a suitable cleaning of the converter).

A conventional physical structure of a catalytic converter, as for instance disclosed in U.S. Pat. No. 3,885,977, is a ceramic honeycomb monolith with parallel, open channels. The catalytic material is deposited onto the walls of the honeycomb channels. As the gas flows from one end to the other, the catalytic conversion takes place. This type of structure generally works well provided that the temperature of the device is above the light-off temperature. However, at cold-start situations, the hazardous compounds flow through the channels without conversion.

In order to reduce the amounts of hazardous compounds that are released during cold start it is a well known technique to use adsorption traps, i.e. to deposit a material, besides the catalysts, that adsorbs and retains cold hydrocarbons and/or nitrogene oxides until the catalyst reaches the light-off temperature. As an example, this is disclosed in WO95/18292. A problem with this technique when applied to the conventional physical structure described above is that the desorption temperature for most compounds generally is lower than the temperature required for conversion. A great deal of the hazardous compounds will thus still flow through the channels without conversion.

Another approach to solve the problem with cold converters is to introduce electric heating, as disclosed in, for instance WO92/14912. It is, however, difficult to make the heating fast enough and the costs for components and energy are high. This kind of electric heating may also be a safety risk (electricity, fire).

Another important feature is the pressure drop over the purification device as energy is needed to overcome the gas flow resistance of the device. For instance, an increased pressure drop over a purification device for a vehicle engine could result in an increased consumption of fuel.

One technique that has been proposed more recently is the combination of a catalytic purification device and a heat exchanger permitting heat exchange between the incoming gas and the outgoing gas. This technique makes it possible to utilize the heat in the exhaust gas in a more efficient way which is an advantage under most, if not all, operating conditions. EP 1016777 discloses a construction that consists of a corrugated metal strip that is folded onto itself into a bundle that forms gas flow passages between the foldings. However, the shape of the corrugation of the metal strip forms a number of small passages within each larger passage between the foldings, and as the incoming gas flow enters the larger passages from their side, most of the gas will flow in the small passages that are located closest to the side from which the gas was fed. In other words, the gas enters the bundle from the side, and due to difficulties to flow across the larger passages, the gas flow is not distributed within the width of the larger passages. This leads to an overall gas flow distribution that is not uniform. Although this construction is of principal interest, the uneven flow distribution over the catalyst may lead to an insufficient conversion, a less efficient heat exchange and to a high pressure drop over the construction. Furthermore, metal constructions are generally prone to degrade in the rough environment of an exhaust gas flow.

DISCLOSURE

One object of the present invention is to provide a device for the treatment of a gasflow that, compared to known systems, converts the gas more efficiently and exhibits a lower pressure drop.

The invention concerns a device for the treatment of a gas flow. The device comprises (includes, but is not necessarily limited to) at least one body, at least one first opening for entrance of an incoming gas flow to the body and at least one second opening for the exit of an outgoing gas flow from the body. The body is provided with a plurality of gas flow passages arranged to permit heat exchange between the gas flows in adjacent passages. The device includes at least one distribution section in communication with the first opening and with the gas flow passages to distribute the incoming gas flow to the gas flow passages. At least one gas flow passage section is provided that includes the gas flow passages, and which passage section primarily is adapted to permit heat exchange and to cause a conversion in the composition of the gas. An advantageous effect of this feature is that an improved gas flow distribution is achieved which makes it possible to both utilize the potentially available surfaces within the gas treatment device in a more efficient way, and to lower the pressure drop over the construction. A more efficient utilization of the surfaces can, for instance, be used to achieve a further conversion (e.g. purification) of the gas, to decrease the space required for the device by making it smaller, and to make the device cheaper by decreasing its content of catalytic material for a given level of conversion.

In an advantageous embodiment of the invention, the distribution section is adapted to distribute the incoming gas flow within the individual gas flow passages. This way the gas flow will not only be distributed among the different flow passages, but also within the individual passages which further increases the potential efficiency of the device. Preferably, the distribution section is adapted to bring about a substantially uniform gas flow within the individual gas flow passages.

In a second advantageous embodiment of the invention, the distribution section forms a part of the body. Preferably, the distribution section is in communication with the second opening to also lead the outgoing gas flow out from the gas flow passages. Such an arrangement makes it possible to give the device a compact design. Additionally, it makes it possible to additionally perform heat exchange in the distribution section.

In a third advantageous embodiment of the invention, the gas flow passages extend essentially parallel to each other, and further, the main direction of gas flow in one gas flow passage is essentially the opposite of the main direction of gas flow in an adjacent gas flow passage.

Thereby it is possible to achieve a counter-current heat exchange process for highest efficiency.

In a fourth advantageous embodiment of the invention, the body comprises a strip that is folded into a zigzag structure, and spacer means are arranged between the foldings of the zigzag structure in such a way that a distance is achieved between two foldings that face each other in the zigzag structure, and the gas flow passages thereby are formed between the foldings of the zigzag structure. The spacer means are arranged to facilitate the distribution of the incoming gas flow in the distribution section. This arrangement allows the gas to freely flow across the gas flow passages and thus be distributed within the width of the passages. An advantageous effect of creating the gas flow passages in a folded strip by using spacer means is that it is a flexible system and it gives many possibilities to arrange the distribution section. Another advantageous effect is that it gives increased freedom in the design of the surface of the strip; the surface may, for instance, be essentially non-patterned to decrease flow resistance.

In a fifth advantageous embodiment of the invention, the body comprises a strip that is folded into a zigzag structure. The surface of the strip at least partly exhibits a three-dimensional pattern, preferably corrugations, and the three-dimensional pattern is arranged to give rise to contact points and gaps between two foldings that face each other in the zigzag structure. The gas flow passages are thereby formed in the gaps between the foldings of the zigzag structure, and the surface of at least one of two foldings that face each other differ from the three-dimensional pattern in the distribution section in such a way that distribution of the incoming gas flow is facilitated. Also, this arrangement allows the gas to freely flow across the gas flow passages and thus be distributed within the width of the passages. An advantageous effect of creating the gas flow passages and the distribution section in a folded strip by using different kinds of surface patterns is that the construction contains fewer parts.

In a sixth advantageous embodiment of the invention, the distribution section and the gas flow passage section form separate units that are arranged together in such a way that gas can flow from one section to the other, preferably the distribution section and the gas flow passage section are joined to each other. In this way the sections can be produced individually which makes it possible to optimize the production process and make it more cost-effective.

In a seventh advantageous embodiment of the invention, the distribution section comprises a wall structure forming at least one first channel to which the incoming gas flow is fed. A plurality of second channels extend from the first channel and are open to the gas flow passages that are intended for an incoming gas flow. This enables a simple construction and a good distribution of the incoming gas flow. Preferably, the first channel is closed to the gas flow passages. In this manner, the incoming gas is forced to flow via the second channels which leads to an even more uniform distribution.

In a further aspect, the wall structure forms a plurality of third channels that are open to the gas flow passages that are intended for an outgoing gas flow. Preferably, these third channels are formed between the second channels using common walls. This is an advantageous way of leading the gas out as heat exchange can also take place in the distribution section; and further, no additional walls are needed.

In an eighth advantageous embodiment of the invention, the distribution section comprises a zigzag shaped wall structure forming a first and a second set of channels; one set on each side of the zigzag shaped structure. The first set of channels are open to the gas flow passages that are intended for an incoming gas flow and the second set of channels are open to the gas flow passages that are intended for an outgoing gas flow. The incoming gas flow is fed to the first set of channels. This design also enables a simple construction and a good distribution of the incoming gas flow.

In a ninth advantageous embodiment of the invention, the distribution section exhibits, in at least one certain direction, a substantially unchanged cross section. In this way it is possible to produce the section by an extruding means which is a cost-effective production process.

Preferably, the distribution section and the gas flow passage section are made out of a ceramic material and the sections are joined to each other by sintering means. This gives a favorable construction since a ceramic material, compared to metal, has a lower material cost, a lower cost of production, lower thermal expansion, a better wash-coat adhesion and has a lower thermal mass per wall volume. A construction made out of a ceramic material is also less prone to degradation in the hostile environment of an exhaust gas flow.

In a tenth advantageous embodiment of the invention, the body has a substantially cylindrical shape; and preferably the body has the general shape of a circular cylinder. The body comprises an internal cavity that extends in the longitudinal direction thereof, and at least one first or second opening is directed towards the cavity so that the gas flow at least partly is led via the cavity. An advantageous effect of this design is that the device requires less space. A further advantage, especially in a vehicle exhaust gas purification application, is that the device can be made with a long and narrow physical shape that can be arranged with its longitudinal axis in line with the exhaust pipe. By distributing the gas flow passages around the internal cavity and/or along the longitudinal axis of the body, this design enables a low pressure drop and advantageous packaging characteristics.

DESCRIPTION OF DRAWINGS

The invention will now be described in greater detail with reference to the following drawings wherein.

MODE FOR INVENTION

Figure 1:
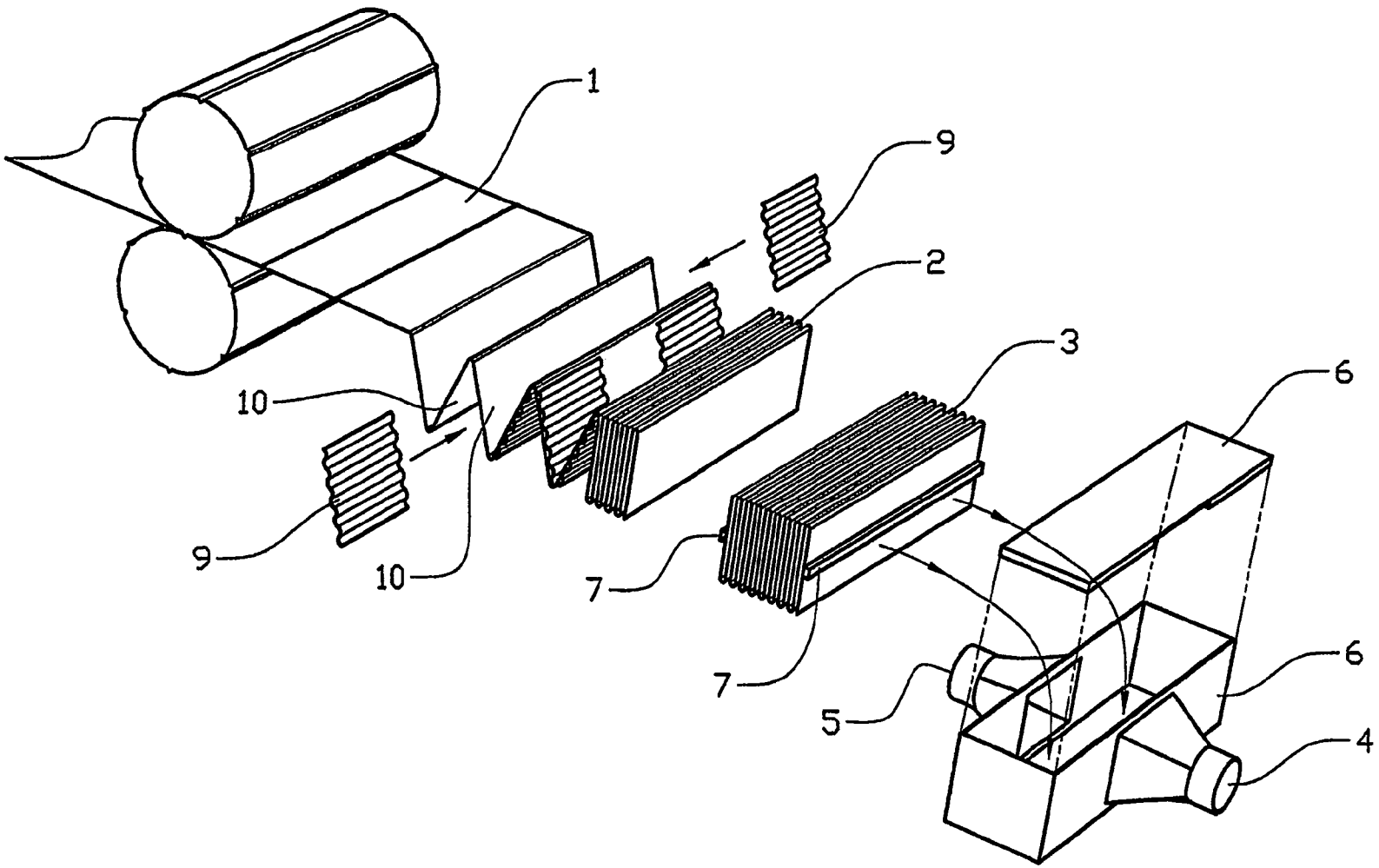
FIG. 1 is a perspective view showing, in overview, an example of a method for producing and constructing a gas treatment device according to a first advantageous embodiment of the invention.

FIG. 1 shows an overview example of a method for producing and constructing a gas treatment device according to a first advantageous embodiment of the invention. A strip 1 is folded into a zigzag structure 2. Spacer means in the form of corrugated plates 9 are arranged between the foldings 10 of the zigzag structure 2 in such a way that a distance is achieved between two foldings 10 that face each other in the zigzag structure 2. This distance makes it possible to feed a gas flow between the foldings 10. The corrugated plates 9 are arranged to leave some central space free from spacer means. This free space forms a part of a distribution section 26 that will be further described in relation to FIG. 2. The zigzag structure 2 may be formed to bodies of different geometrical shapes, depending usually on the application of the device. In FIG. 1, the zigzag structure 2 forms a body 3 with the shape of a bundle. The body 3 is placed into a casing 6 that encloses the body 3 and the casing 6 is provided with a first opening 4 for entrance of an incoming gas flow to the body 3 and a second opening 5 for the exit of an outgoing gas flow from the body 3. Seals or sealing means 7 prevent gas from flowing under or over the body 3. In order to adapt the body 3 to cause a conversion in the composition of the gas, at least a part of the surfaces of the body 3 that are in contact with the gas flow are preferably coated with a catalyst material.

Figure 2:
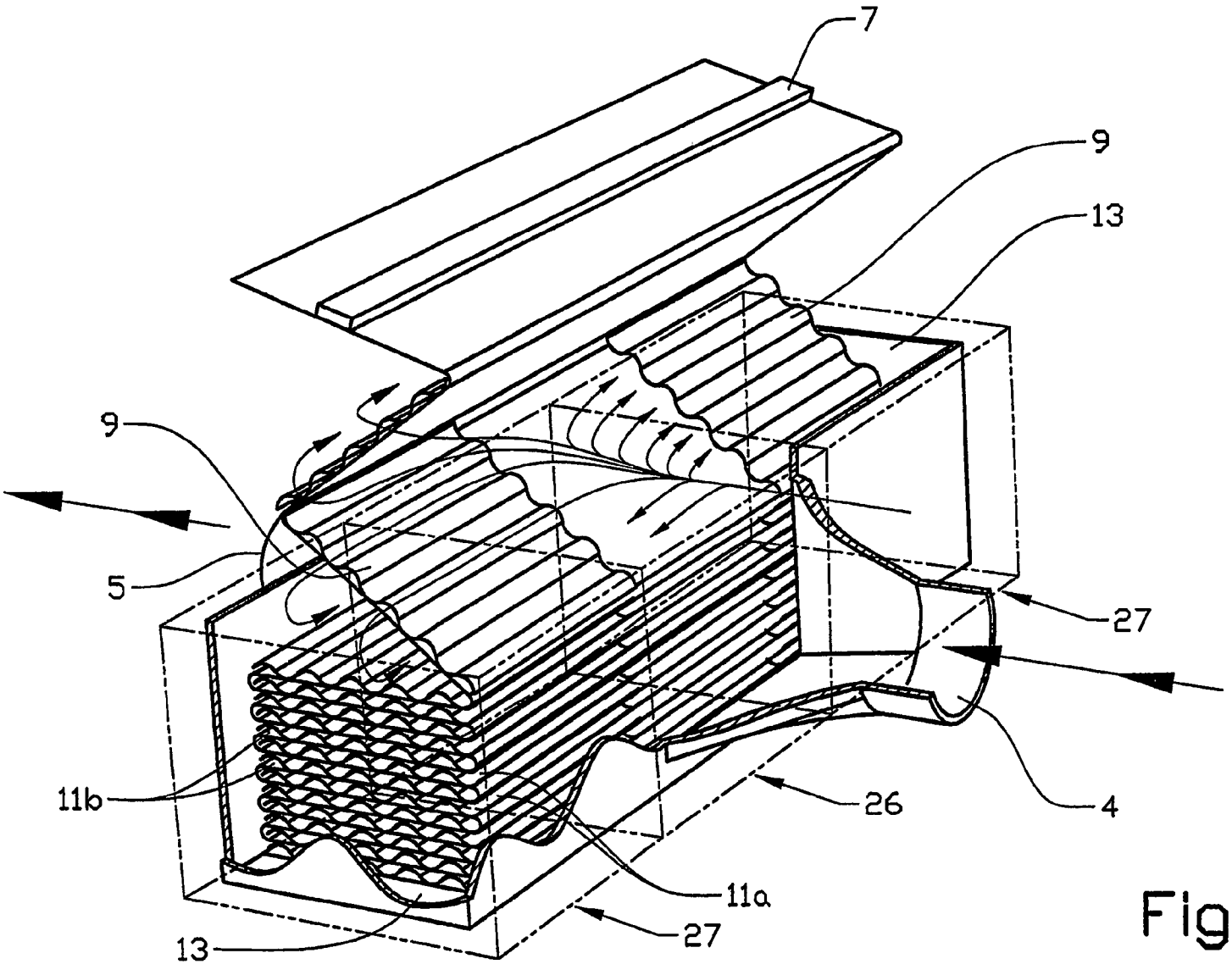
FIG. 2 is a perspective view showing in greater detail the first advantageous embodiment of the invention of FIG. 1.

FIG. 2 shows in greater detail the first advantageous embodiment of the invention as in FIG. 1. For the sake of clarity, the zigzag structure is partly unfolded. Due to the arrangement of the corrugated plates 9, a plurality of gas flow passages 11*a*, 11*b* are formed between the foldings 10 in the body 3. Every second of said gas flow passages 11*a*, 11*b* are open to the first opening 4, and which is referred to as the gas flow inlet passages 11*a*. The other passages, the gas flow outlet passages 11*b*, are open to the second opening 5. The incoming gas is fed via the first opening 4 into the distribution section 26 in which it divides into two main flows with opposite directions (to the left and to the right as seen from the direction of the incoming gas flow) and enters the inlet passages 11*a* in each of the gas flow passage sections 27. At both ends of the casing 6, the gas flow enters a reversing chamber 13 where the gas leaves the inlet passages 11*a* and enters the outlet passages 11*b* through which the gas flows to the second opening 5 and exits the casing 6. A counter-current heat exchange is thus permitted between adjacent gas flow passages.

Inside the first opening 4, the distribution section 26 is located. In this section the corrugated plates 9 are arranged to facilitate the distribution of the incoming gas flow over the width of the gas flow inlet passages 11*a*. As mentioned above, the distribution section 26 is in this case formed by a void in the presence of plates 9 so that the incoming gas easily can flow across the inlet passages 11*a*. In this manner, the gas flow can be uniformly distributed over the width of the individual inlet passages 11*a*.

As the gas passes the distribution section 26, it enters a gas flow passage section 27 comprising the corrugated plates 9. Thus, the device comprises one distribution section 26 and two gas flow passage sections 27. In addition, the device comprises two reversing zones in the form of reversing chambers 13. Since the structure of the distribution section 26 in FIG. 2 is similar inside both the first opening 4 and the second opening 5, the distribution section 26 also facilitates the transport of the outgoing gas flow from the outlet passages. This feature reduces the pressure drop over the construction.

The spacer means are not limited to corrugated plates 9, but can for instance comprise a mesh-wire net. Further, the spacer means may exhibit filtering properties for removal of particulates. Filtering material may also be placed in the distance between the foldings 10.

As an alternative to spacer means, the surface of the strip 1 may exhibit a three-dimensional pattern, preferably corrugations, arranged to give rise to contact points and gaps between two foldings 10 that face each other in the zigzag structure 2. The frequency of the corrugations may for instance differ between adjacent foldings 10.

Alternatively, the phase of the corrugations may be shifted between adjacent foldings 10. The gas flow passages 11*a*, 11*b* are thereby formed in the gaps between the foldings 10. Preferably, said three-dimensional pattern extends over an area of the foldings 10 corresponding to the area covered by the corrugated plates 9 in FIGS. 1 and 2. The distribution section 26 can thus be located inside the first opening 4 in a similar way as shown in FIG. 2. In this distribution section 26, the surfaces of the foldings 10 can be arranged to differ from the three-dimensional pattern. The surfaces may, for instance, be substantially non-patterned so that no, or only a few, contact points are created in the distribution section 26. The effect of this arrangement is similar to that described above; that is, that the incoming gas can easily flow across the inlet passages 11*a* in the distribution section 26 and thereby the gas flow can be uniformly distributed over the width of the inlet passages 11*a*.

Figure 3:
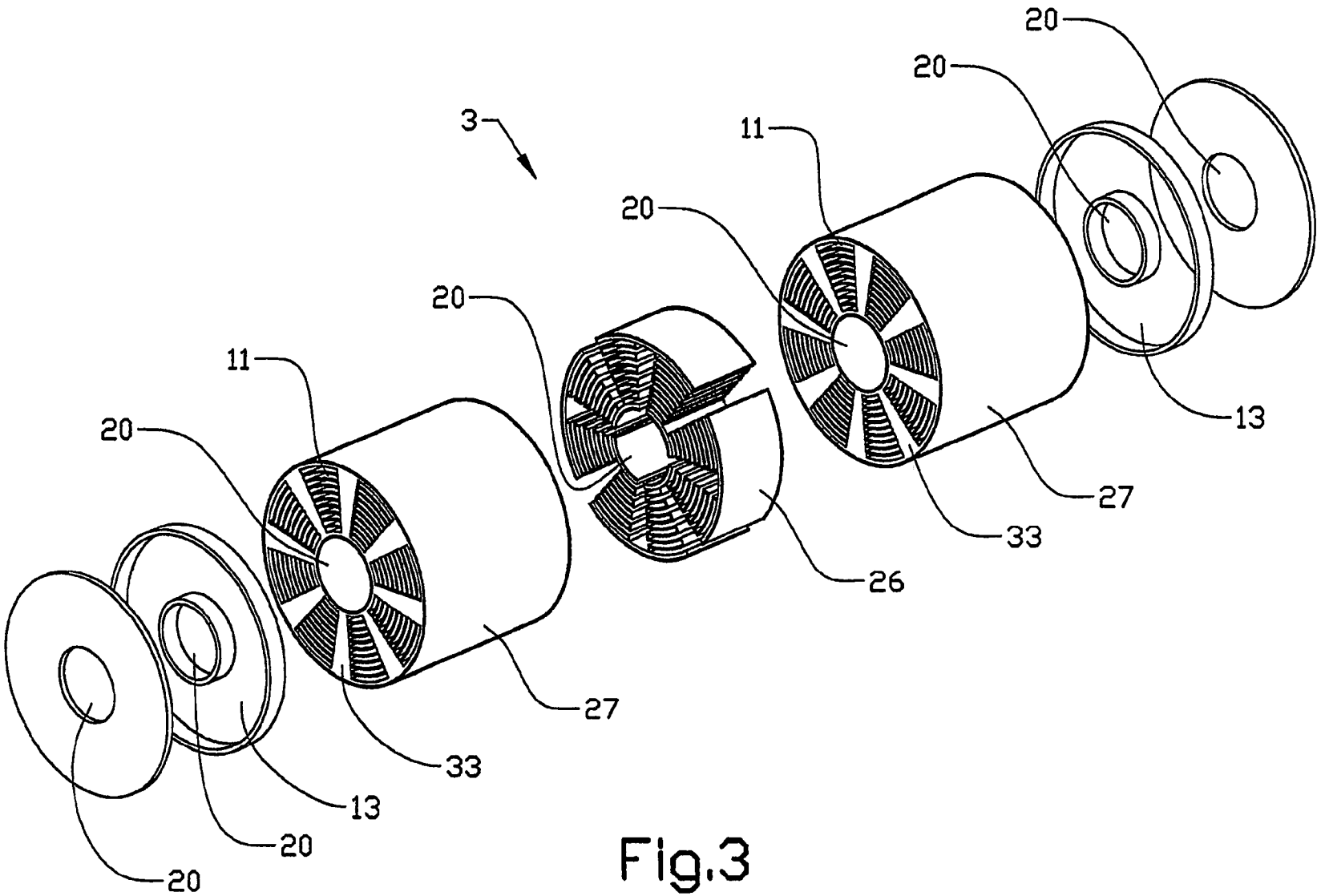
FIG. 3 is an exploded perspective view showing a second advantageous embodiment of the invention.

A second advantageous embodiment of the invention is shown in FIGS. 3 to 10. In this illustrated embodiment, the distribution section and the gas flow passage section form separate units that are joined to each other. FIG. 3 shows, in an exploded perspective view, the structure of a body 3 comprising one distribution section 26, two gas flow passage sections 27 and two reversing zones in the form of reversing chambers 13. Each passage section 27 is provided with a plurality of gas flow passages 11, and, compared with the thin walls defining the gas flow passages 11, relatively thick supporting walls 33 that divide the gas flow passage section into a number of sectors. The body 3 has the shape of a circular cylinder and comprises an internal cavity 20 that extends in the longitudinal direction of the body. The incoming gas flow is fed into the body 3 via the internal cavity 20 and the outgoing gas flow leaves the body 3 via its periphery. These flow processes are further described below.

Figure 4:
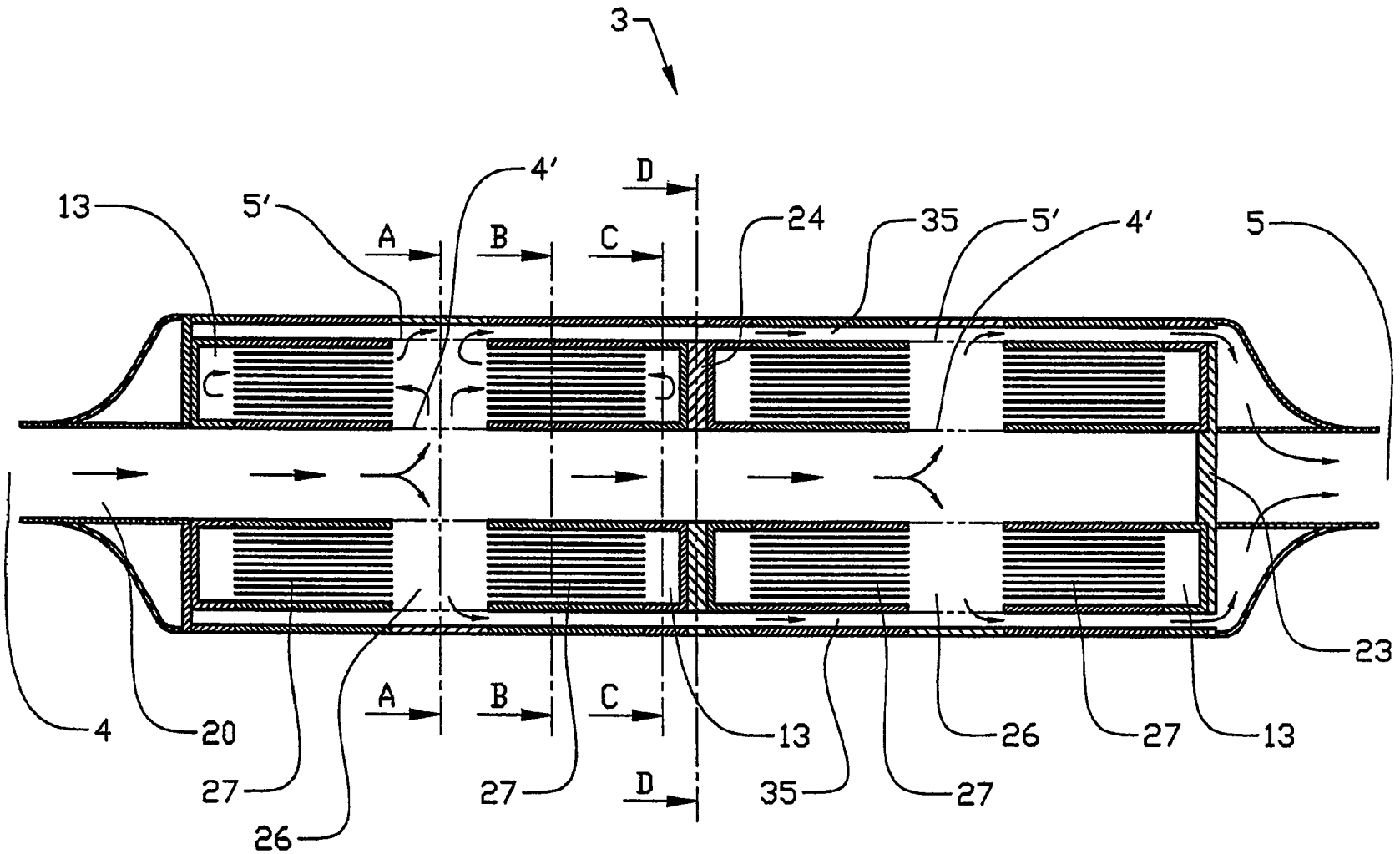
FIG. 4 is a schematic sectional view of a variant of the second advantageous embodiment of the invention as shown in FIG. 3.

FIG. 4 shows a schematic sectional view of a variant of the second embodiment in which the body 3 constitutes two sub-bodies that have been joined together, and wherein each sub-body has a structure according to FIG. 3. The body 3 has also been provided with surrounding equipment for leading the gas to and from the body 3. FIGS. 5, 6, 7 and 8 shows sectional views A-A, B-B, C-C and D-D, respectively, according to FIG. 4. The structure of the distribution section 26 is not shown in FIG. 4, but in FIG. 5.

Figure 5:
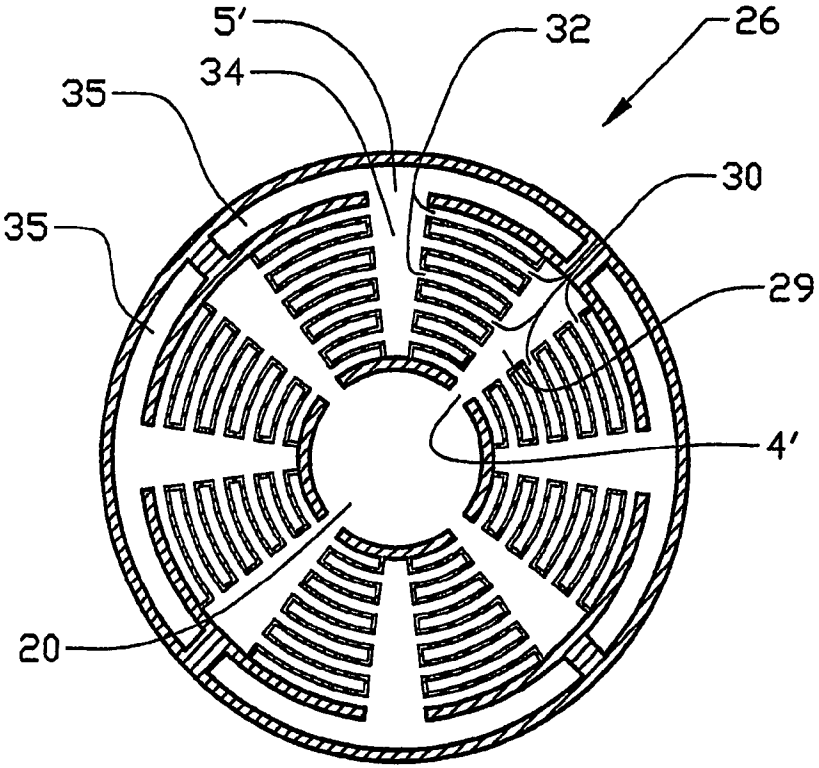
FIG. 5 is a sectional view taken along line A-A in FIG. 4.

The incoming gas flow is fed into the body 3 through the first opening 4 into the internal cavity 20. The other end 23 of the cavity 20, opposite to that of the first opening 4, is closed, and which has the effect that the incoming gas flow is forced through the first openings 4' of each distribution section 26. As can be seen in FIG. 5, the distribution section 26 constitutes of a wall structure forming (as an example) four first channels 29 that communicate with the internal cavity 20 via the first openings 4' and to which first channels 29 the incoming gas flow is fed. The wall structure further forms a plurality of second channels 30 (in the Figure there are, as an example, five in each direction) that extend from each of the first channels 29.

Figure 6:
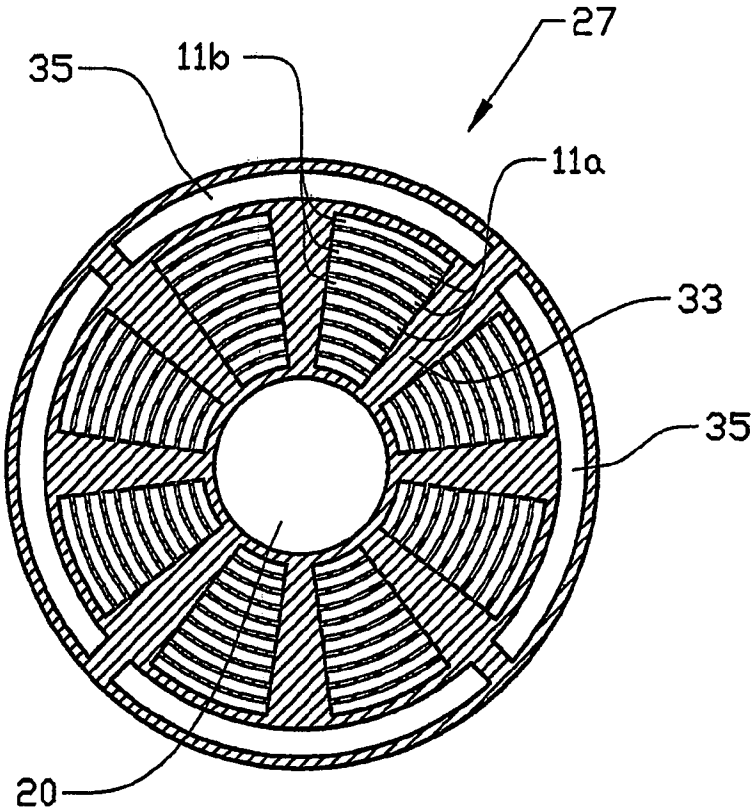
FIG. 6 is a sectional view taken along line B-B in FIG. 4.

As can be seen in FIG. 6, the exemplary gas flow passage section 27 is provided with a plurality of gas flow passages 11*a*, 11*b*. Every second of these passages forms an inlet passage 11*a* intended for an incoming gas flow, and every second passage forms an outlet passage 11*b*, intended for an outgoing gas flow. The second channels 30 (FIG. 5) are open to the gas flow inlet passages 11*a*, whereas the first channels 29 are closed to all gas-flow passages 11*a*, 11*b* by the ends of the supporting walls 33. In order to make it possible to use thinner supporting walls 33 and thereby decrease the amount of construction material in the body, the direct passage from the first channels 29 to the gas flow passages 11*a*, 11*b* can be closed by blocking means, for instance thin plates, or by plugging appropriate parts of the passages. As the incoming gas flow is fed through the first openings 4' into the first channels 29, the gas is forced to be distributed into the second channels 30. From the second channels 30, the gas flow is fed to the inlet passages 11*a*. Further, the gas flows through the inlet passages 11*a* and enters the reversing chamber 13 allowing the gas flow to change direction and flow back to the distribution section 26 via the outlet passages 11*b*.

The wall structure forming the first channels 29 and the second channels 30 in the distribution section 26 also forms a plurality of third channels 32 (in the Figure there are, as an example, five in each direction) between the second channels 30 using common walls. The third channels 32 are open to the gas flow outlet passages 11*b*. Two sets of the third channels 32 emerge into a common fourth channel 34. In FIG. 5, it can be seen that the distribution section 26, as an example, is provided with four fourth channels 34. The outgoing gas flow enters the third channels 32 from the outlet passages lib and exits the distribution section 26 via the fourth channels 34 and a second opening 5' into an outlet channel 35 in the periphery of the body 3. At the end of the body 3, opposite to that of the first opening 4, the outlet channels 35 are combined to a common second opening 5 for the exit of the outgoing gas flow from the body 3.

Figure 8:
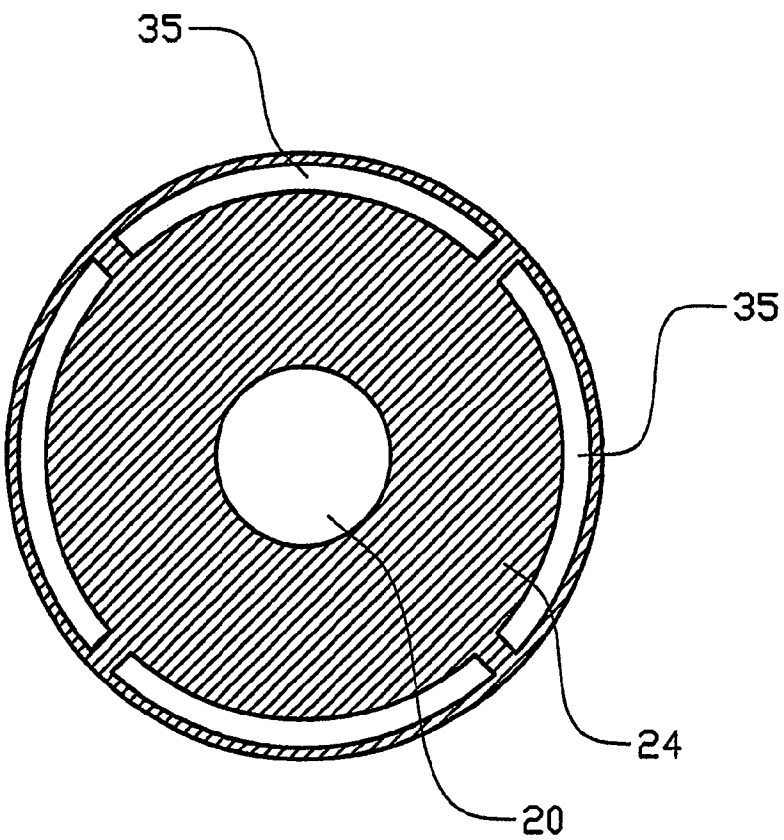
FIG. 8 is a sectional view taken along line D-D in FIG. 4.
Figure 7:
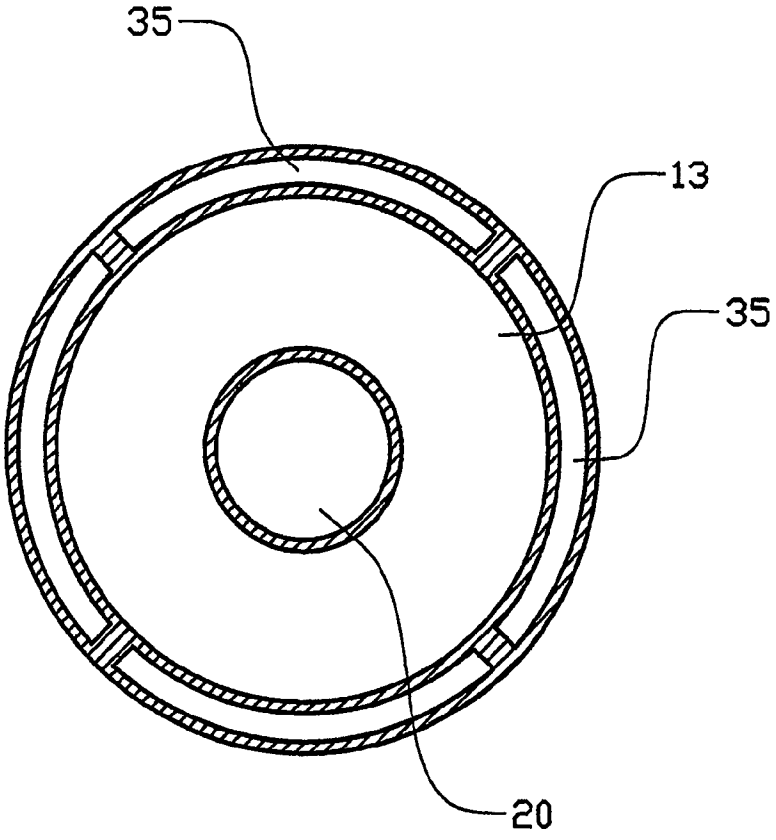
FIG. 7 is a sectional view taken along-line C-C in FIG. 4.

FIG. 7 shows a sectional view of the section comprising the reversing chamber 13. As a variant, the reversing chamber 13 could be divided up into a number of sectors. FIG. 7 also shows the internal cavity 20 and the outlet channels 35. FIG. 8 shows a sectional view of a delimiting plate 24 located between the two sub-bodies. Such plates 24 can be used to stabilize the construction. As an alternative to what is shown in FIG. 4, the delimiting plate 24 may form the end part of the reversing chambers 13 of two adjacent sub-bodies.

In order to lead the gas to the body 3, a pipe (for instance an exhaust pipe) is preferably inserted through the first opening 4 all the way to the other end 23 of the internal cavity 20.

By providing the pipe with openings around its circumference at a location corresponding to the location of the distribution section(s) 26, the gas is permitted to flow into the distribution section(s) via the first openings 4'. A pipe provided with openings can also be inserted through the second opening 5 in order to lead the gas away from the body 3. Such inserted pipes can be used to stabilize the construction.

Figure 10:
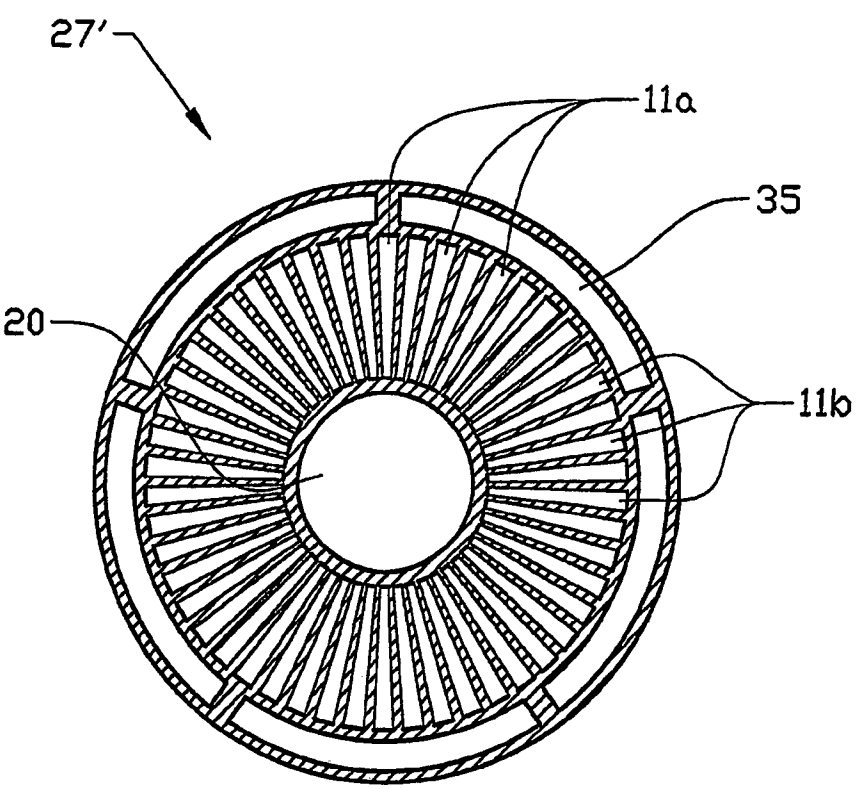
FIG. 10 is a sectional view of the variant of FIG. 9 taken at a location corresponding to that designated as B-B in FIG. 4.
Figure 9:
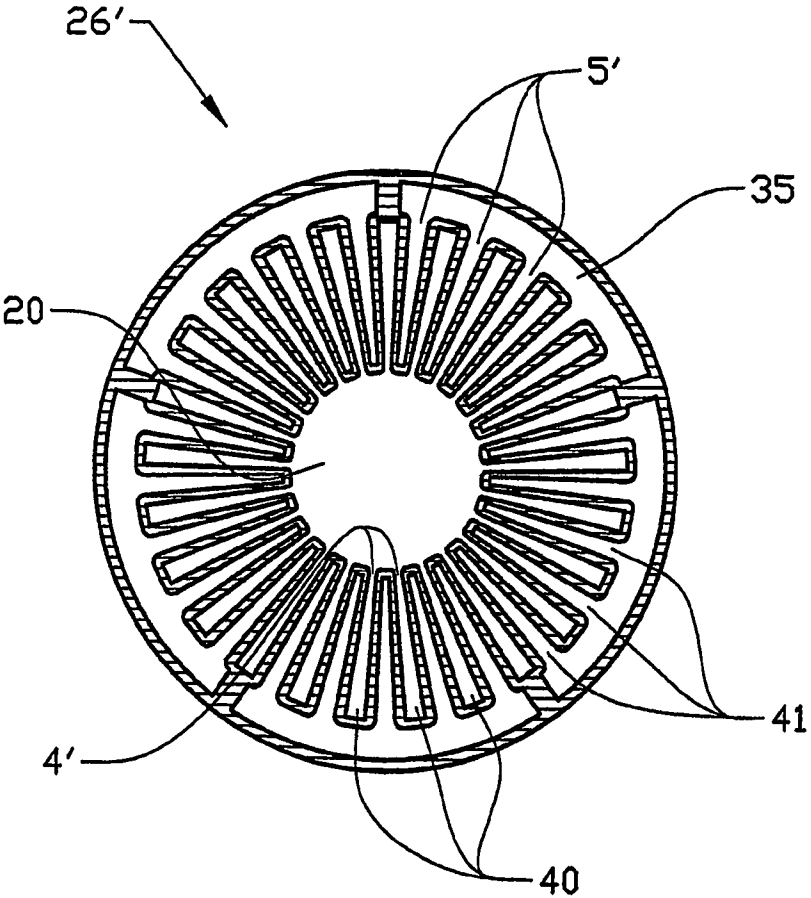
FIG. 9 is a sectional view of an alternative variant of the second advantageous embodiment of the invention taken at a location corresponding to that designated as A-A in FIG. 4.

FIGS. 9 and 10 show an alternative variant of the second embodiment of the invention. The principal of this variant is similar, but the distribution section and the gas flow passage section has a different internal shape. FIG. 9 shows a sectional view taken along the line A-A in FIG. 4, but of an alternative distribution section 26'. FIG. 10 shows a sectional view taken along the line B-B in FIG. 4, but of the alternative gas flow passage section 27'. Referring to FIG. 9, the distribution section 26' comprises a zigzag shaped wall structure forming a first set of channels 40 and a second set of channels 41, one set on each side of the zigzag shaped structure. The first set of channels 40 are, via the first openings 4', open to the internal cavity 20 and to the gas flow passages that are intended for an incoming gas flow such as that represented by the inlet passages 11*a*. The second set of channels 41 are open to the gas flow passages that are intended for an outgoing gas flow such as that represented by the outlet passages 11*b*, and to the outlet channels 35.

The appearance of the gas flow passages 11*a*, 11*b* is shown in FIG. 10, wherein every second passage forms an inlet passage 11*a* and every second passage forms an outlet passage 11*b* in similarity to what is mentioned previously. In this variant of the invention, the gas flows in a similar way as described above; that is, it enters the internal cavity 20 via the first opening 4, enters the first set of channels 40 via the first openings 4', flows through the inlet channels 11*a* to the reversing chamber 13 where it changes direction and flows through the outlet channels 11*b* to the second set of channels 41, and passes the second openings 5' into the outlet channels 35.

An advantage of using more than one sub-body, as exemplified in FIG. 4, is that the incoming gas flow can be divided into several smaller gas flows which increases the efficiency of the device and lowers the pressure drop over the construction. Of course, more than two sub-bodies can be arranged together. Other arrangements are also possible; one example is to arrange only one gas flow passage section 27 adjacent to the distribution section 26 and thus block the other side of the distribution section 26. This arrangement may be used to achieve a higher mechanical stability of the construction. Another alternative is to reverse the direction of the gas flow so that the gas enters the body 3 via the outlet channels 35 and exits the body 3 through the first opening 4.

As seen from FIGS. 3 to 10, both the distribution section 26, 26' and the gas flow passage section 27, 27' exhibit a substantially unchanged cross section in the longitudinal direction of the body. This means that these sections may be produced by extruding means which is a cost-effective production method that is suitable both for metal and ceramic material.

Preferably, all sections/parts of the construction are made out of a ceramic material and joined to each other by sintering means. This gives a durable construction. To achieve a heat exchange effect between the inlet and outlet passages, the walls separating the passages must be reasonably thin. For a ceramic material, a wall thickness of about 0.1 mm would give a fast heat transfer through the wall compared to the heat transfer from the gas to the wall. An example of a suitable ceramic material is cordierite.

Regarding the alternative variant of the second embodiment shown in FIGS. 9 and 10, it is possible to produce/extrude the distribution section 26' and the gas flow passage section 27' in one piece so that the first set of channels 40 forms a part of the inlet passages 11*a* and the second set of channels 41 forms a part of the outlet channels 11*b*. The internal cavity 20 and the openings to the distribution section 26' can in such a case be arranged by inserting a pipe provided with circumferential holes as described previously. Another pipe provided with openings from the distribution section 26' can be arranged on the outside of the channel/passage structure.

Figure 11:
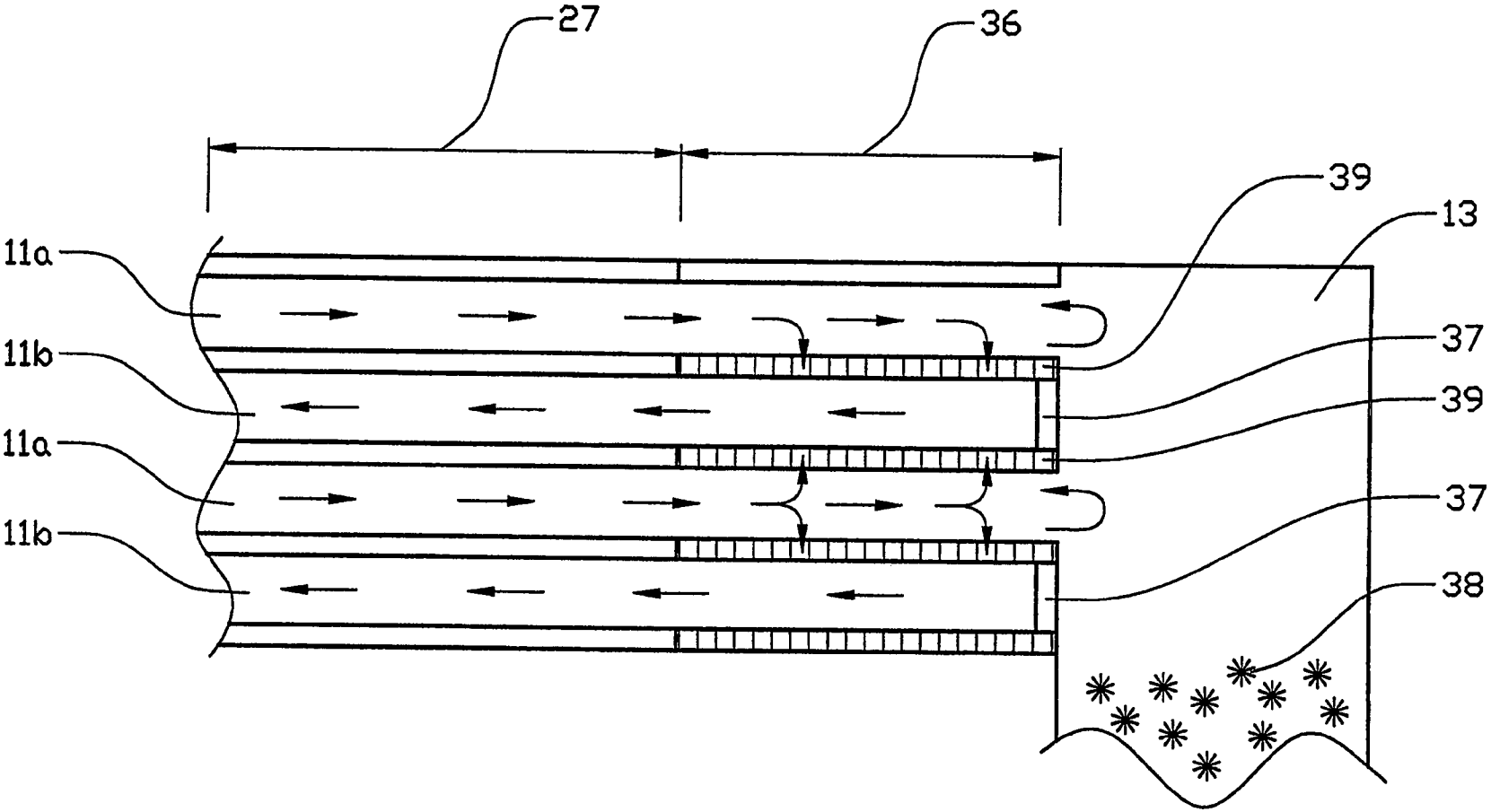
FIG. 11 is a schematic showing a further development of the second embodiment of the invention according to FIGS. 3 and 4.

A further development of the second embodiment of the invention as seen in FIGS. 3 and 4 is the adaptation of the device to remove particulates in the gas. FIG. 11 schematically shows the principles of a gas flow filtering section 36 arranged between a gas flow passage section 27 and the section forming the reversing chamber 13. Although the design of the reversing chamber 13 may be similar to the above descriptions, it has in this case a different function as will be described below. Both the passage section 27 and the filtering section 36 are provided with gas flow inlet and outlet passages 11*a*, 11*b* as described above. Plugs 37 close the outlet passages 11*b* to the reversing chamber 13. The walls 39 between the passages 11*a*, 11*b* in the filtering section 36 exhibit a porous structure through which gas can pass but particles can not (that is, those larger than a certain size), and which at least partly will be deposited in the reversing chamber 13.

These walls 39 thus work as filters. Due to the plugs 37, a pressure builds up in the reversing chamber 13. The gas flow in the inlet passages 11*a* is thus forced through the walls 39 in the filtering section 36 into the outlet passages 11*b* back to the passage section 27, as indicated by arrows in FIG. 11. Principally, the filtering process could be carried out in the passage section 27, but porous walls in this section would decrease the heat exchange properties. After some time, the filtering walls 39 and the reversing chamber 13 need to be regenerated by combustion of the soot. Due to the heat exchange properties of the invention, the heat evolved in this process can be utilized efficiently in that the outgoing gas preheats the incoming gas in the gas flow passage section 27. As an aid in this process, a heating coil can be placed in the reversing chamber 13. In conventional ceramic particle filters, the ash produced in the soot combustion process accumulates in the filtering channels occupying useful filter volume.

According to FIG. 11, the ash 38 can instead at least partly be accumulated in the reversing chamber 13. In some applications, the volume of the reversing chamber 13 is sufficient for accumulating ash 38 during the service life of the gas treatment device. In other cases, it is possible to provide the reversing chamber 13 with emptying means, such as an opening that is closed under normal operation.

The filtering section 36 shown in FIG. 11 is easily adapted to fit between the gas flow passage section 27 and the section forming the reversing chamber 13 shown in FIGS. 3 and 4. Further, the principal shape of the filtering section 36 is the same as that of the passage section 27. Thus, the filtering section 36 also exhibits a substantially unchanged cross-section in a certain direction and may therefore be produced by extruding means, be made out of a ceramic material, and joined by sintering to other ceramic sections. The plugs 37 can be arranged by conventional means during or after such an extruding process. Of course, the filtering section 36 can be adapted to be used together with the alternative gas flow passage section 27' shown in FIG. 10.

Although the use of the ash-accumulating reversing chamber 13 is advantageous, it is also possible to use the filtering section 36 without the reversing chamber 13; that is, by also plugging the inlet passages 11*a* or by substituting the reversing chamber 13 for a delimiting plate 24.

An advantage of using a counter-current heat exchange in the treatment of a gas flow according to the invention is that the heat can be utilized very efficiently. Besides the amount of heat contained in the incoming gas, heat may be supplied to the gas from exothermic reactions in the body. This is preferably accomplished by using a catalyst material that has been coated onto at least a part of the surfaces in the body that are in contact with the gas flow. Heat may also be supplied by an external source such as a heat generator, preferably arranged in the reversing zone. As the outgoing gas flow during its transport from the reversing chamber 13 to the second opening 5, 5' can transfer a great deal of its heat to the incoming gas flow from the first opening 4, 4' to the reversing chamber 13, only a small part of the supplied heat will leave the body 3 with the outgoing gas flow and thus be wasted. A good heat economy is especially important if the incoming gas flow is relatively cold so that the temperature might fall below the catalyst light-off temperature described hereinabove. An example of this is when the device is applied to purify the exhaust gases of a diesel engine.

The heat exchange process according to the invention is also very useful in temperature transient situations, such as the purification of exhaust gases from an internal combustion engine during cold-start. In such an application of the invention, the body 3 is preferably provided with both a catalyst material and an adsorption/desorption agent applied to at least a part of the surfaces in the body 3 that are in contact with the gas flow. The agent preferably adsorbs hydrocarbons and/or nitrogen oxides at, or below, a first temperature and releases them at, or above, a second temperature which is higher than the first temperature. As the exhaust gases enter the cold body 3, heat will be transferred from the gas to the material comprised in the body 3. The first part of the heat exchanger surfaces (i.e., the material in or close to the distribution section 26 located closest to the first opening 4, 4') heats up quickly while the part close to the reversing chamber 13 heats up slowly. As the body is arranged to permit heat exchange between adjacent passages, the heat exchanger surfaces closest to the second opening 5, 5' will also heat up quickly. A gas flow passing the device shortly after start up will thus experience a first hot zone at the entrance of the body 3, a zone with gradually decreasing temperature (the inlet passages 11*a*), a zone with gradually increasing temperature (the outlet passages 11*b*), and a second hot zone before exit out of the body 3. Compounds adsorbed onto adsorption/desorption agents applied to surfaces in the first hot zone will relatively quickly desorb, but will be adsorbed again onto agents applied to colder surfaces close to the reversing chamber 13. As the temperature increases with time close to the reversing chamber 13, the compounds will again desorb. This time, however, the compounds will be transported towards zones with higher temperatures. By properly designing the body and choosing catalyst material and adsorption/desorption agents, the temperature in at least the hottest zone will be above the catalyst light-off temperature so that the compounds are effectively and efficiently converted.

In order to improve heat economy and to reduce the amounts of adsorption/desorption agents and catalysts required, one may carefully choose the body surfaces to which catalysts and agents should be applied. For instance, catalysts for oxidizing HC and CO and reducing NOx may chiefly be applied in the hotter zones of the body (in or close to the distribution section 26), and adsorption/desorption agents may chiefly be applied in the colder zones (in or close to the reversing chamber 13).

In order to control the temperature of the gas flow in the body, the device preferably comprises one or several of the following: a heat generator arranged in the body (preferably arranged in the reversing chamber), cooling flanges arranged in the body, arrangements for introducing cooling air into the body, and/or a system for controlling the composition of the incoming gas flow. The system preferably comprises an arrangement for introduction of oxidizing species, such as air, into the incoming gas flow, and/or an arrangement for introduction of oxidizable species, such as hydrocarbons, into the incoming gas flow. Due to the heat exchange properties of the device, the heat generated in the induced chemical reactions can effectively be taken care of.

If the device is arranged in connection to an engine, the system for controlling the composition of the incoming gas flow preferably comprises an arrangement for controlling the operation of the engine, which operation in turn can effect the composition of the incoming gas flow. For instance, by mixing additional amounts of fuel in one or several of the cylinders, one may introduce fuel; i.e., hydrocarbons, into the exhaust gas that is to be purified in the gas treatment device.

The distribution section(s) are thus primarily adapted to distribute the incoming gas flow to the gas flow passages. The passage section(s) are primarily adapted to permit heat exchange and to cause a conversion in the composition of the gas, and the filtering section(s) is primarily adapted to remove particulates from the gas. Of course, this does not prevent that, for instance, heat exchange or gas conversion takes place in a distribution section, or that heat exchange takes place in a filtering section.

The invention is not limited to the above described embodiments, but a number of modifications are possible within the frame of the patented claims. For instance, the reversing zone may be designed in different ways. One example is to substitute the reversing chamber 13 for transfer passages, for example, holes between the gas flow inlet and outlet passages.

Further, the first embodiment of the invention is not limited to the variant shown in FIGS. 1 and 2. The zigzag structure 2 can, for instance, be shaped to other geometrical structures. One example is to distribute the foldings 10 uniformly around an internal cavity so that the zigzag structure 2 takes the form of a circular cylinder with a longitudinal internal cavity. The gas can thus be fed to the body via the cavity. A variant of this is to form a discreet distribution of the foldings around the cavity wherein a number of sub-bodies are distributed around the cavity. The shape of the distribution section 26, i.e. the shape of the corrugated plates 9, may also be modified to suit different applications. Seen in the direction of the incoming gas flow, the distribution section 26 may for instance be narrowing or expanding.

Regarding the second embodiment of the invention, it is possible to use a conventional monolith with a large number of narrow flow passages (and provided with the internal cavity 20) as an alternative to the gas flow passage sections 27, 27' shown in FIGS. 6 and 10. Each of the gas flow passages in FIG. 6 or 10 would in such a case be substituted for a number of more narrow side-by-side passages. With a proper design, this arrangement would give a more stable construction and only have a slight effect on the heat exchange due to the additional body content of material required for the additional walls. It would, however, increase the pressure drop and require more material.

Modifications within the frame of the claims are also possible to improve the gas flow through the body in order to reduce the pressure drop and/or distribute the gas flow in a better way or make the heat exchange more efficient. Such modifications may depend on the application of the invention. In the case of the second embodiment shown in FIGS. 3-11, one may for instance vary the number of sub-bodies or connect a distribution section 26 to only one gas flow passage section 27. Further, one may vary the design of the walls forming the gas flow passages 11 in order to vary the size of the surface area and/or the number of gas flow passages 11. Further, the walls can be arranged so that the flow resistance of the passages 11 varies with the distance from the internal cavity 20. Additionally, one may vary the diameter of the internal cavity 20 which will affect the distribution of the gas flow. A larger diameter would, for instance, reduce the gas velocity which in turn would decrease the pressure drop caused by the deflection of the gas flow from the internal cavity 20 into the distribution section 26.

Of course it is also possible to provide the gas flow passage section 27 with gas permeable walls 39 so that the passage section 27 exhibits both heat exchange and filtering properties. In such a case, it is not necessary to use an additional filtering section 36 to achieve filtering properties.

The invention claimed is:

1. A device for treatment of a gas flow, comprising at least one body (3), having a substantially cylindrical shape, said body (3) having at least one first opening (4) for entrance of an incoming gas flow to said body (3) and at least one second opening (5) for the exit of an outgoing gas flow from said body (3), said body (3) comprising a distribution section (26, 26') and a gas flow passage section (27, 27'), and wherein said gas flow passage section (27, 27') is provided with a plurality of inlet gas flow passages (11*a*) and outlet gas flow passages (11*b*), said inlet and outlet gas flow passages (11*a*, 11*b*) extending substantially parallel to one another so as to permit heat exchange between the gas flows in adjacent passages and to cause a conversion in the composition of the gas, said body (3) further comprising a reversing zone (13) in fluid communication with said inlet and outlet gas flow passages (11*a*, 11*b*) such that the main direction of the gas flow in the inlet gas flow passages (11a) is essentially the opposite of the main direction of the gas flow in the outlet gas flow passages (11*b*), the distribution section (26, 26') is in communication with the first opening (4) to lead the ingoing gas flow into the inlet gas flow passages (11*a*) and with the second opening (5, 5') to lead the outgoing gas flow out from the outlet gas flow passages (11*b*), and the distribution section (26, 26') comprises one set of channels (30, 40) which are open to the inlet gas flow passages (11*a*) and another set of channels (32, 41) that are open to the outlet gas flow passages (11*b*), wherein the distribution section (26, 26') comprises an internal cavity (20) that extends in the longitudinal direction of the body (3), said internal cavity (20) is in communication with the first opening (4) and, along said longitudinal direction, with the set of channels (30, 40) which are open to the inlet gas flow passages (11*a*), to lead the ingoing gas flow into the inlet gas flow passages (11*a*);

the distribution section (26) comprises a wall structure forming: at least one first channel (29) to which the incoming gas flow is fed; and a plurality of second channels (30) that extend from said first channel (29) and which second channels (30) are open to the gas flow passages (11*a*, 11*b*) that are intended for an incoming gas flow; and said internal cavity (20) is closed at an end (23) opposite to said first opening (4).

2. A device as recited in claim 1, wherein the distribution section (26, 26') is configured to distribute the incoming gas flow within the individual gas flow passages (11*a*, 11*b*).

3. A device as recited in claim 2, wherein the distribution section (26,26') is configured to bring about a substantially uniform gas flow within the individual gas flow passages (11*a*, 11*b*).

4. A device as recited in claim 1, wherein the distribution section (26, 26') and the gas flow passage section (27, 27') form separate units arranged together in such a way that gas can flow from one section to the other with the distribution section (26, 26') and the gas flow passage section (27, 27') being joined to each other.

5. A device as recited in claim 4, wherein the distribution section (26, 26') is produced by extruding means.

6. A device as recited in claim 4, wherein the distribution section (26, 26') and the gas flow passage section (27, 27') are made out of a ceramic material, and the sections are joined to each other by sintering means.

7. A device according to claim 1, wherein said inlet gas flow passages (11*a*) are closed to said internal cavity (20).

8. A device as recited in claim 7, wherein the distribution section (26) comprises a wall structure forming: at least one first channel (29) to which the incoming gas flow is fed; and a plurality of second channels (30) that extend from said first channel (29) and which second channels (30) are open to the gas flow passages (11*a*, 11*b*) that are configured for an incoming gas flow.

9. A device as recited in claim 8, wherein the first channel (29) is closed to the gas flow passages (11*a*, 11*b*).

10. A device as recited in claim 8, wherein the wall structure forms a plurality of third channels (32) which forms said set of channels that are open to the outlet gas flow passages (11*a*, 11*b*).

11. A device according to claim 1, wherein said set of channels (30, 40) which are open to the inlet gas flow passages (11*a*) and said set of channels (32, 41) that are open to the outlet gas flow passages (11*b*) are formed using common walls.

12. A device as recited in claim 11, wherein the distribution section (26') comprises a zigzag shaped wall structure forming a first and a second set of channels (40,41), one set on each side of said zigzag shaped structure, wherein said first set of channels (40) are open to the gas flow passages (11*a*,11*b*) that are intended for an incoming gas flow and said second set of channels (41) are open to the gas flow passages (11*a*,11*b*) that are intended for an outgoing gas flow, and wherein the incoming gas flow is fed to the first set of channels (40).

13. A device as recited in claim 1, wherein the distribution section (26, 26') in at least one certain direction exhibits a substantially unchanged cross section.

14. A device as recited in claim 1, wherein the device comprises at least one filtering section (36), said filtering section (36) being adapted to remove particulates from the gas.

15. A device as recited in claim 1, wherein at least a part of the surfaces in the body (3) that are in contact with the gas flow are coated with a catalyst material.

16. A device as recited in claim 1, wherein at least a part of the surfaces in the body (3) that are in contact with the gas flow are coated with an adsorption/desorption agent.

17. A device as recited in claim 1, wherein the device comprises means for controlling the temperature of the gas flow in the body (3) and taking the form of at least one of (i) a heat generator arranged in the body (3), (ii) cooling flanges arranged in the body (3), (iii) an arrangement configured to introduce cooling air into the body (3), and (iv) a system for controlling the composition of the incoming gas flow.

18. A device as recited in claim 17, wherein the system for controlling the composition of the incoming gas flow comprises at least one of (i) an arrangement for introduction of oxidizing species, such as air, into the incoming gas flow, and (ii) an arrangement for introduction of oxidizable species into the incoming gas flow.

19. A device as recited in claim 17, wherein the device is arranged in connection to a combustion engine, and said system for controlling the composition of the incoming gas flow comprises an arrangement for controlling the operation of the combustion engine, which operation in turn affects the composition of the incoming gas flow.

20. A device as recited in claim 1, wherein the device is adapted to purify the exhaust gas from an internal combustion engine, preferably in a mobile application.

21. A device for treatment of a gas flow, comprising at least one body (3), at least one first opening (4, 4') for entrance of an incoming gas flow to said body (3) and at least one second opening (5, 5') for the exit of an outgoing gas flow from said body (3), wherein said body (3) is provided with a plurality of gas flow passages (11*a*, 11*b*) arranged to permit heat exchange between the gas flows in adjacent passages, wherein the device comprises at least one distribution section (26,26') in communication with the first opening (4, 4') and with the gas flow passages (11*a*, 11*b*) to distribute the incoming gas flow to the gas flow passages (11*a*, 11*b*), and at least one gas flow passage section (27, 27') including said gas flow passages (11*a*, 11*b*), which passage section (27, 27'm) is adapted to permit said heat exchange between gas distributed in adjacent gas flow passages and to cause a conversion in the composition of the gas, said body (3) further comprising a reversing chamber (13) in fluid communication with said inlet and outlet gas flow passages (11*a*, l1*b*), wherein the distribution section (26, 26') and the gas flow passage section (27, 27') form separate units that are arranged together in such a way that gas can flow from one section to the other, wherein the distribution section (26) comprises a wall structure forming: at least one first channel (29) to which the incoming gas flow is fed; and a plurality of second channels (30) that extend from said first channel (29) and which second channels (30) are open to the gas flow passages (11*a*, 11*b*) that are intended for an incoming gas flow.

22. The device of claim 21, wherein the distribution section (26, 26') and the gas flow passage section (27, 27') are joined to each other.

23. A device for treatment of a gas flow, comprising at least one body (3), at least one first opening (4, 4') for entrance of an incoming gas flow to said body (3) and at least one second opening (5, 5') for the exit of an outgoing gas flow from said body (3), wherein said body (3) is provided with a plurality of gas flow passages (11*a*, 11*b*) arranged to permit heat exchange between the gas flows in adjacent passages, wherein the device comprises at least one distribution section (26,26') in communication with the first opening (4, 4') and with the gas flow passages (11*a*, 11*b*) to distribute the incoming gas flow to the gas flow passages (11*a*, 11*b*), and at least one gas flow passage section (27, 27') including said gas flow passages (11*a*, 11*b*), which passage section (27, 27') is adapted to permit said heat exchange between gas distributed in adjacent gas flow passages and to cause a conversion in the composition of the gas, said body (3) further comprising a reversing chamber (13) in fluid communication with said inlet and outlet gas flow passages (11*a*, l1*b*), wherein the distribution section (26, 26') and the gas flow passage section (27, 27') form separate units that are arranged together in such a way that gas can flow from one section to the other, wherein the distribution section (26) comprises a wall structure forming: at least one first channel (29) to which the incoming gas flow is fed; and a plurality of second channels (30) that extend from said first channel (29) and which second channels (30) are open to the gas flow passages (11*a*, 11*b*) that are intended for an incoming gas flow, and wherein the distribution section (26, 26') is in communication with the second opening (5, 5') to also lead the outgoing gas flow out from the gas flow passages (1l*a*, 11*b*).

24. The device of claim 23, wherein the distribution section (26, 26') and the gas flow passage section (27, 27') are joined to each other.

* * * * *